US009349524B2

(12) United States Patent
Shiokawa et al.

(10) Patent No.: US 9,349,524 B2
(45) Date of Patent: May 24, 2016

(54) WIRE-WOUND ELECTRONIC COMPONENT

(71) Applicant: MURATA MANUFACTURING CO., LTD., Kyoto (JP)

(72) Inventors: Noboru Shiokawa, Nagaokakyo (JP); Kenichiro Maki, Nagaokakyo (JP); Katsuyuki Takahashi, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 52 days.

(21) Appl. No.: 14/050,159

(22) Filed: Oct. 9, 2013

(65) Prior Publication Data

US 2014/0104026 A1 Apr. 17, 2014

(30) Foreign Application Priority Data

Oct. 17, 2012 (JP) ..... 2012-229534

(51) Int. Cl.

| | |
|---|---|
| ***H01F 27/29*** | (2006.01) |
| ***H01F 27/02*** | (2006.01) |
| ***H01F 17/04*** | (2006.01) |
| ***H01F 27/28*** | (2006.01) |

(52) U.S. Cl.

CPC ..... *H01F 27/29* (2013.01); *H01F 17/04* (2013.01); *H01F 27/2828* (2013.01)

(58) Field of Classification Search

CPC ..... H01F 27/29

See application file for complete search history.

(56) References Cited

U.S. PATENT DOCUMENTS

| | | | | |
|---|---|---|---|---|
| 6,087,920 | A | 7/2000 | Abramov | |
| 6,198,373 | B1 | 3/2001 | Ogawa et al. | |
| 6,223,419 | B1 | 5/2001 | Abramov | |
| 6,348,850 | B1 | 2/2002 | Kimura et al. | |
| 6,392,523 | B1 * | 5/2002 | Tsunemi | 336/192 |
| 6,535,093 | B1 | 3/2003 | Murata et al. | |

FOREIGN PATENT DOCUMENTS

| | | | |
|---|---|---|---|
| CN | 1210345 | A | 3/1999 |
| JP | S60-109312 | U | 7/1985 |
| JP | H01-199418 | A | 8/1989 |
| JP | H8-055728 | A | 2/1996 |
| JP | H09-306744 | A | 11/1997 |
| JP | 2000-269050 | A | 9/2000 |

(Continued)

OTHER PUBLICATIONS

English translation of JP2012029210.*

(Continued)

*Primary Examiner* — Elvin G Enad
*Assistant Examiner* — Ronald Hinson
(74) *Attorney, Agent, or Firm* — Studebaker & Brackett PC

(57) ABSTRACT

A wire-wound electronic component includes a core having a winding base extending in an axial direction, a flange provided at an end of the winding base in the axial direction, and a wire wound around the winding base. An external electrode is provided on a plurality of side surfaces of the flange and is connected to an end of the wire, where the side surfaces are orthogonal to the axial direction. A connecting surface on which the end of the wire contacts with the external electrode is one of the side surfaces that is different from one of the side surfaces that functions as a mounting surface, and the external electrode extends from the mounting surface to the end of the wire in such a manner to turn in a direction same as a winding direction of the wire.

7 Claims, 7 Drawing Sheets

(56) References Cited

FOREIGN PATENT DOCUMENTS

| | | | |
|---|---|---|---|
| JP | 2001-102220 | A | 4/2001 |
| JP | 2001-511313 | A | 8/2001 |
| JP | 2003-077739 | A | 3/2003 |
| JP | 2006-286807 | A | 10/2006 |
| JP | 2008-016617 | A | 1/2008 |
| JP | 2008-130940 | A | 6/2008 |
| JP | 2011-082463 | A | 4/2011 |
| JP | 2011-171544 | A | 9/2011 |
| JP | 2012-029210 | A | 2/2012 |

OTHER PUBLICATIONS

English translation of JP2008130940A.*

An Office Action; "Notification of Reasons for Refusal," issued by the Japanese Patent Office on Sep. 2, 2014, which corresponds to Japanese Patent Application No. 2012-229534 and is related to U.S. Appl. No. 14/050,159; with English language translation.

* cited by examiner

WIRE-WOUND ELECTRONIC COMPONENT

CROSS REFERENCE TO RELATED APPLICATIONS

This application is based on Japanese Patent Application No. 2012-229534 filed on Oct. 17, 2012, the entire content of which is incorporated herein by reference.

TECHNICAL FIELD

The technical field relates to a wire-wound electronic component, and more particularly to a wire-wound electronic component to be used as an inductor or the like.

BACKGROUND

As an example of conventional wire-wound electronic components, a wire-wound coil component as disclosed by Japanese Patent Laid-Open Publication No. 2011-171544 is known. A wire-wound coil component 500 disclosed by Japanese Patent Laid-Open Publication No. 2011-171544 will now be described. FIG. 7 is a sectional view of the wire-wound coil component 500 and a direction in which the central axis of a winding base 501 extends is referred to as an x-axis direction, and a direction perpendicular to the x-axis direction is referred to as a y-axis direction.

As shown by FIG. 7, the wire-wound coil component 500 comprises a winding base 501, flanges 502*a* and 502*b*, a wire 504, and external electrodes 506*a* and 506*a*. The winding base 501 extends in the x-axis direction. The flanges 502*a* and 502*b* are provided at both ends of the winding base 501.

The external electrodes 506*a* and 506*a* are provided on the surfaces of the flanges 502*a* and 502*b*, respectively, in the negative side in the y-axis direction. The wire 504 is wound around the winding base 501, and both ends of the wire 504 are connected to the external electrodes 506*a* and 506*a* provided on the flanges 502*a* and 502*b*, respectively.

The inductance value of the wire-wound coil component 500 of the structure above is generally affected by the number of turns of the wire 504. With the wound-wire coil component 500, accordingly, it may be possible to achieve a high inductance value by increasing the number of turns of the wire 504. In the wire-wound coil component 500, therefore, a high inductance value is achieved by increasing the number of turns of the wire 504 without changing the diameter of the wire 504.

SUMMARY

It is an object of the present invention to provide a wire-wound electronic component that can achieve a higher inductance value without causing an increase in size.

A wire-wound electronic component according to an embodiment of the present disclosure includes a core having a winding base extending in an axial direction, a first flange provided at a first end of the winding base in the axial direction, and a wire wound around the winding base. A first external electrode is provided on a plurality of first side surfaces of the first flange and is connected to a first end of the wire, where the first side surfaces are orthogonal to the axial direction. A first connecting surface on which the first end of the wire contacts with the first external electrode is one of the first side surfaces that is different from one of the first side surfaces that functions as a first mounting surface, and the first external electrode extends from the first mounting surface to the first end of the wire in such a manner to turn in a direction same as a winding direction of the wire.

BRIEF DESCRIPTION OF THE DRAWINGS

The features of the present disclosure will be apparent from the following description with reference to the accompanying drawings.

DETAILED DESCRIPTION

The inventors realized that with recent demands for downsized electronic components, including downsizing of the wire-wound coil component 500, a decrease in size of the wire-wound coil component 500 causes a reduction in space for the winding base 501 used for winding of the wire 504, and therefore, it is difficult to provide a downsized wire-wound coil component having a high inductance value. A wire-wound electronic component according to an exemplary embodiment of the present disclosure, which can address this shortcoming, will be described below.

Structure of the Wire-Wound Electronic Component

Figure 1:
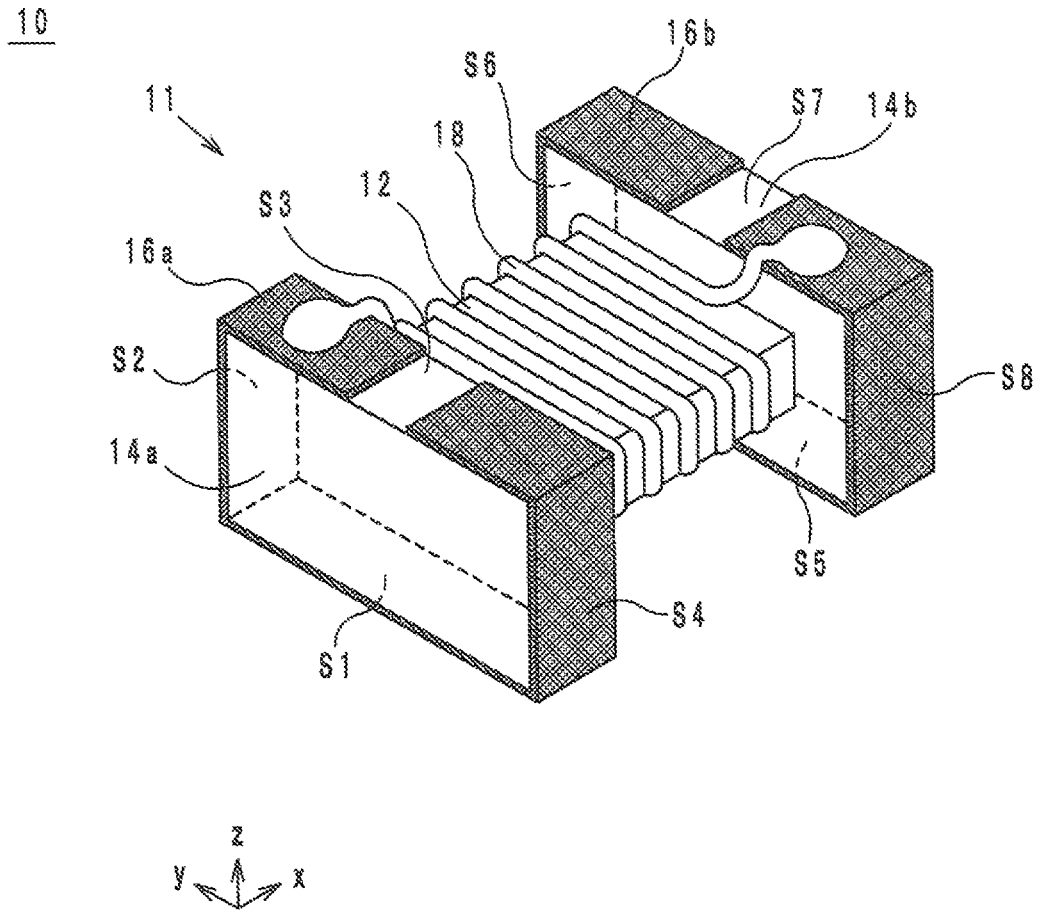
FIG. 1 is a perspective view of a wire-wound electronic component according to an exemplary embodiment.

First, the structure of the wire-wound electronic component according to an exemplary embodiment is described. FIG. 1 is a perspective view of the wire-wound electronic component 10 according to an exemplary embodiment. In FIG. 1, a direction in which the central axis of a winding base 12 extends is referred to as an x-axis direction. A direction in which the longer sides of a flange 14*a* extend when viewed from the x-axis direction is referred to as a y-axis direction. A direction in which the shorter sides of the flange 14*a* extend when viewed from the x-axis direction is referred to as a z-axis direction. The x-axis, the y-axis and the z-axis are orthogonal to one another.

As shown by FIG. 1, the wire-wound electronic component 10 comprises a core 11, external electrodes 16*a* and 16*a*, and a wire 18. The core 11 is made of an insulating material such as ferrite, alumina or the like. The core 11 has a winding base 12, and flanges 14*a* and 14*b*. The winding base 12 is, as shown in FIG. 1, a prismatic body extending in the x-axis direction. The winding base 12 is not necessarily prismatic and may be cylindrical or polygonal.

The flange 14*a*, as shown in FIG. 1, is provided at an end of the winding base 12 in a negative side in the x-axis direction. The flange 14*b* is provided at an end of the winding base 12 in a positive side in the x-axis direction. Both of the flanges 14*a* and 14*b* are in the shape of a rectangular parallelepiped, and protrude from the winding base 12 in the z-axis direction and in the y-axis direction. The flange 14*b* is symmetrical with the flange 14*a* about a plane that includes the midpoint of the winding base 12 in the direction of the central axis and that is parallel to the y-axis direction and the z-axis direction.

Hence, the core 11 is in the shape of an H when viewed from the y-axis direction. Also, the core 11 is in the shape of an H when viewed from the z-axis direction.

A surface of the flange 14*a* in the negative side in the z-axis direction is referred to as a side surface S1. A surface of the flange 14*a* in the positive side in the y-axis direction is referred to as a side surface S2. A surface of the flange 14*a* in the positive side in the z-axis direction is referred to as a side surface S3. A surface of the flange 14*a* in the negative side in the y-axis direction is referred to as a side surface S4. A surface of the flange 14*b* in the negative side in the z-axis direction is referred to as a side surface S5. A surface of the flange 14*b* in the positive side in the y-axis direction is referred to as a side surface S6. A surface of the flange 14*b* in the positive side in the z-axis direction is referred to as a side surface S7. A surface of the flange 14*b* in the negative side in the y-axis direction is referred to as a side surface S8.

The external electrodes 16*a* and 16*a* are made of, for example, a Ni-based alloy (such as Ni—Cr, Ni—Cu, Ni or the like), Ag, Cu, Sn or the like. The external electrode 16*a*, as shown in FIG. 1, is formed so as to cover the side surfaces S1 to S4 of the flange 14*a*. However, the external electrode 16*a* is partly cut off substantially in the center of the side surface S3 in the y-axis direction. Therefore, the external electrode 16*a* is in the shape of a C having an opening in the positive side in the z-axis direction when viewed from the x-axis direction. The cross-section area of the external electrode 16*a* on a plane parallel to the x-axis direction and the z-axis direction, i.e., in a width and thickness direction of the external electrode 16*a* is greater than the cross-section area of the wire 18, which will be described later.

The external electrode 16*a*, as shown in FIG. 1, is formed so as to cover the side surfaces S5 to S8 of the flange 14*b*. However, the external electrode 16*a* is partly cut off substantially in the center of the side surface S7 in the y-axis direction. Therefore, the external electrode 16*a* is in the shape of a C having an opening in the positive side in the z-axis direction when viewed from the x-axis direction. The cross-section area of the external electrode 16*a* on a plane parallel to the x-axis direction and the z-axis direction, i.e., in a width and thickness direction of the external electrode 16*a* is greater than the cross-section area of the wire 18, which will be described later.

When the wire-wound electronic component 10 is mounted on a circuit board, the part of the external electrode 16*a* located on the side surface S1 and the part of the external electrode 16*a* located on the side surface S5 are electrically connected to electrodes of the circuit board by soldering or the like. That is, the side surfaces S1 and S5 function as mounting surfaces of the wire-wound electronic component 10.

The wire 18 is a conductive wire having a conductive core coated with an insulating material such as polyurethane. The wire 18, as shown in FIG. 1, is wound around the winding base 12. The end of the wire 18 located in the negative side in the x-axis direction contacts with the part of the external electrode 16*a* located on the side surface S3 (first connecting surface), in the positive side in the y-axis direction. Accordingly, the turning direction of the external electrode 16*a* from the end of the wire 18 to the side surface S1 (first mounting surface) is the same as the winding direction of the wire 18. Thereby, the part of the external electrode 16*a* from the end of the wire 18 to the side surface S1 (first mounting surface) functions as an extension of the winding wire 18.

The end of the wire 18 located in the positive side in the x-axis direction, as shown in FIG. 1, contacts with the part of the external electrode 16*a* located on the side surface S7 (second connecting surface), in the negative side in the y-axis direction. Accordingly, the turning direction of the external electrode 16*a* from the end of the wire 18 to the side surface S5 (second mounting surface) is the same as the winding direction of the wire 18. Thereby, the part of the external electrode 16*a* from the end of the wire 18 to the side surface S5 (second mounting surface) functions as an extension of the winding wire 18.

Manufacturing Method of the Wire-Wound Electronic Component

A manufacturing method of the wire-wound electronic component is described in the following.

First, powder of a ferrite-based material is prepared as the material of the core 11. The ferrite powder is filled in a female die and compressed by a male die to become molded into the shape of the core 11 having the winding base 12 and the flanges 14*a* and 14*b*. After the compression, the molded core 11 is baked, and thereby, the core 11 is completed.

Next, the external electrodes 16*a* and 16*a* are formed on the flanges 14*a* and 14*b* of the core 11. More specifically, the side surfaces S1 to S4 of the flange 14*a* and the side surfaces S5 to S8 of the flange 14*b* are dipped in a container filled with Ag paste such that the Ag paste sticks to the side surfaces S1 to S8. The Ag paste stuck on the side surfaces S1 to S8 is dried and baked, so that Ag films, which function as base electrodes, are formed on the surfaces S1 to S8 of the flanges 14*a* and 14*b*. Further, metal films of a Ni-based alloy are formed on the respective Ag films by electrodeposition or the like. Thereafter, the metal film of a Ni-based alloy and the Ag film formed on the side surface S3 are partly cut off. The position where the films are cut off is substantially the center of the side surface S3 in the y-axis direction. Also, the metal film of a Ni-based alloy and the Ag film formed on the side surface S7 are partly cut off. The position where the films are cut off is substantially the center of the side surface S7 in the y-axis direction. In this way, the external electrodes 16*a* and 16*a* as shown in FIG. 1 are formed.

Next, the wire 18 is wound around the winding base 12 as shown in FIG. 1. In this moment, both end portions, with a predetermined length, of the wire 18 are led out of the winding base 12. The led-out portions of the wire 18 are connected to the corresponding external electrodes 16*a* and 16*a* by thermal compression bonding. Thereby, one end of the wire 18 is contacted with the part of the external electrode 16*a* located on the side surface S3, in the positive side in the y-axis direction. The other end of the wire 18 is contacted with the part of the external electrode 16*a* located on the side surface S7, in the negative side in the y-axis direction. Through the processes above, the wire-wound electronic component 10 is completed.

Advantageous Effects

The wire-wound electronic component 10 of the structure above can achieve a high inductance value without causing an increase in size. This is because the external electrodes 16*a* and 16*a* of the wire-wound electronic component 10 function as extensions of the winding wire 18. More specifically, in the wire-wound electronic component 10, the external electrode 16*a* is formed to cover the side surfaces S1 to S4 of the flange 14*a*, and the external electrode 16*a* is partly cut off on the side surface S3, substantially in the center in the y-axis direction. A first end of the wire 18 contacts with the part of the external electrode 16*a* located on the side surface S3 (first connecting surface), in the positive side in the y-axis direction. Thereby, the turning direction of the external electrode 16*a* from the first end of the wire 18 to the side surface S1 (first mounting surface) is the same as the winding direction of the wire 18. Accordingly, the part of the external electrode 16*a* from the first end of the wire 18 to the side surface S1 (first mounting surface) functions as an extension of the winding wire 18.

Therefore, the number of turns of the wire 18 of the wire-wound electronic component 10 is larger than the number of turns of the wire 504 of the wire-wound coil component 500 when the wire-wound electronic component 10 and the wire-wound coil component 500 are of the same size. Thus, the structure of the wire-wound electronic component 10 permits an increase in the number of turns of the wire, thereby permitting an increase in inductance value, without causing an increase in size. In other words, the wire-wound electronic component 10 can achieve a high inductance value without causing an increase in size.

In the wire-wound electronic component 10, as shown in FIG. 1, the external electrode 16*a* are formed to cover the side surfaces S5 to S8 of the flange 14*b*, and the external electrode 16*a* is partly cut off on the side surface S7, substantially in the center in the y-axis direction. A second end of the wire 18 contacts with the part of the external electrode 16*a* located on the side surface S7 (second connecting surface), in the negative side in the y-axis direction. Thereby, the turning direction of the external electrode 16*a* from the second end of the wire 18 to the side surface S5 (second mounting surface) is the same as the winding direction of the wire 18. Accordingly, the part of the external electrode 16*a* from the second end of the wire 18 to the side surface S5 (second mounting surface) functions as an extension of the winding wire 18. Hence, the wire-wound electronic component 10 can achieve a still higher inductance value.

In the wire-wound electronic component 10, as shown in FIG. 1, the external electrode 16*a* and the wire 18 contacts with each other on the side surface S3 (first connecting surface), and the external electrode 16*a* and the wire 18 contacts with each other on the side surface S7 (second connecting surface). Both of the side surfaces S3 and S7 are located in the positive side in the z-axis direction. In producing the wire-wound electronic component 10, therefore, the compression bonding between the wire 18 and the external electrode 16*a* and the compression bonding between the wire 18 and the external electrode 16*a* can be carried out from the same side. Thus, in the manufacturing process of the wire-wound electronic device 10, the thermal compression bonding of the wire 18 to the external electrodes 16*a* and 16*a* can be simplified.

In the wire-wound electronic component 10, as shown in FIG. 1, the surface on which the external electrode 16*a* and the wire 18 contacts with each other is the side surface S3 (first connecting surface), which is not a mounting surface of the wire-wound electronic component 10. Further, the surface on which the external electrode 16*a* and the wire 18 contacts with each other is the side surface S7 (second connecting surface), which is not a mounting surface of the wire-wound electronic component 10. Accordingly, coating residue after the thermal compression bonding between the wire 18 and the external electrodes 16*a* and 16*a* does not exist on the side surfaces S1 and S5 that are the mounting surfaces of the wire-wound electronic component 10. Therefore, when the wire-wound electronic component 10 is mounted on a circuit board, application of solder to the external electrodes 16*a* and 16*a* can be performed well, and the bonding state between the wire 18 and the respective external electrodes 16*a* and 16*a* is improved.

In the wire-wound electronic component 10, the cross-section areas of the external electrodes 16*a* and 16*a* are greater than that of the wire 18. Accordingly, the electrical resistances per unit length of the external electrodes 16*a* and 16*a* are smaller than that of the wire 18. In the wire-wound electronic component 10, the external electrodes 16*a* and 16*a* function as extensions of the winding wire 18. In sum, in the wire-wound electronic component 10, the winding wire 18 includes, as its extensions, the external electrodes 16*a* and 16*a* with relatively low electrical resistances. The wire-wound electronic component 10, therefore, has a lower resistance than the wire-wound coil component 500 having a winding wire with the same length as the winding wire 18, including the extensions, of the wire-wound electronic component 10.

The inventors conducted an experiment to prove the advantages of the wire-wound electronic component 10. Specifically, the inventors fabricated a first sample corresponding to the wire-wound electronic component 10 and a second sample corresponding to the wire-wound coil component 500 disclosed by Japanese Patent Laid-Open Publication No. 2011-171544. As a first experiment, the inventors monitored the inductance values of the first sample and the second sample while applying alternating voltages to the first sample and the second sample. As a second experiment, the inventors monitored the Q-values of the first sample and the second sample while applying alternating voltages to the first sample and the second sample.

Figure 2:
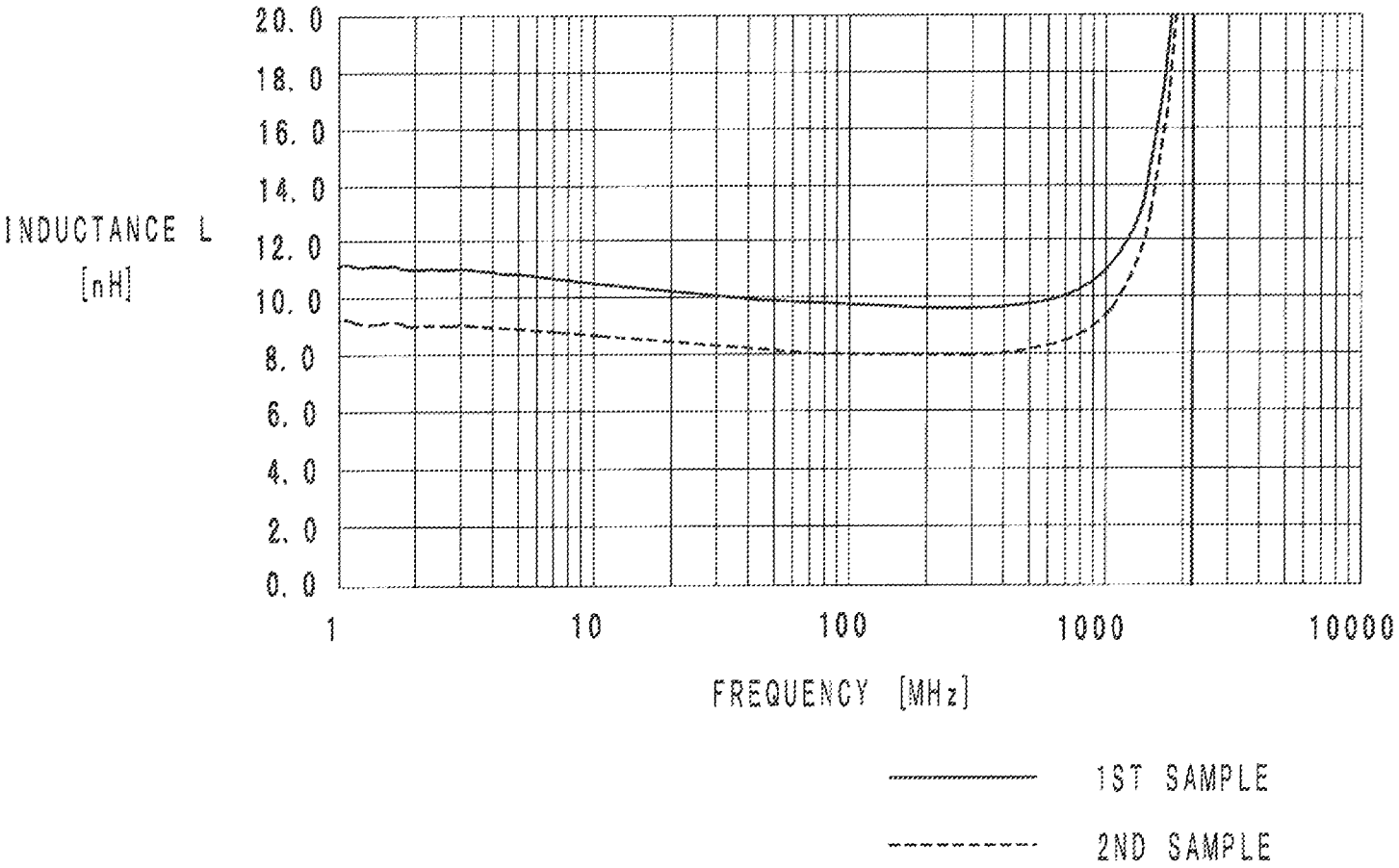
FIG. 2 is a graph showing the results of a first experiment conducted on a first sample and a second sample.
Figure 3:
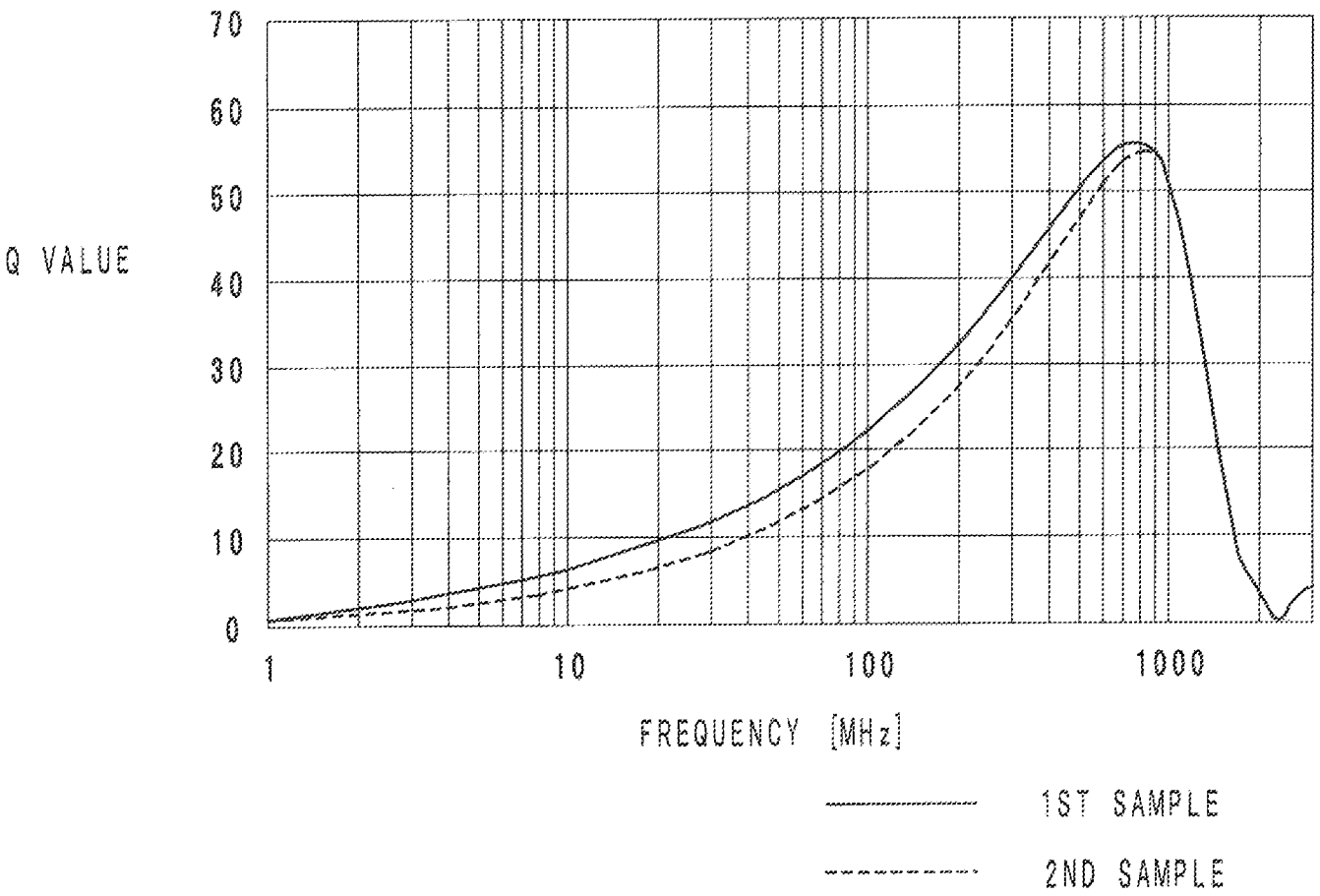
FIG. 3 is a graph showing the results of a second experiment conducted on the first sample and the second sample.

FIG. 2 is a graph showing the results of the first experiment conducted on the first sample and the second sample. FIG. 3 is a graph showing the results of the second experiment conducted on the first sample and the second sample. In FIG. 2, the y-axis shows inductance L, and the x-axis shows frequency. In FIG. 3, the y-axis shows Q-value, and the x-axis shows frequency. In FIGS. 2 and 3, the solid lines show the results of the experiments conducted on the first sample, and the broken lines show the results of the experiments conducted on the second sample.

As is apparent from FIG. 2, which shows the results of the first experiment, the first sample had a higher inductance value than the second sample while an alternating voltage was applied thereto. The experimental results show that the inductance value of the wire-wound electronic component 10 is higher than the inductance value of the wire-wound coil component 500 disclosed by Japanese Patent Laid-Open Publication No. 2011-171544.

Also, as is apparent from FIG. 3, which shows the results of the second experiment, the first sample had a higher Q-value than the second sample while an alternating voltage is applied thereto. The experimental results show that the Q-value of the wire-wound electronic component 10 is higher than the Q-value of the wire-wound coil component 500 disclosed by Japanese Patent Laid-Open Publication No. 2011-171544 and that the wire-wound electronic component 10 has a lower loss than the wire-wound coil component 500 disclosed by Japanese Patent Laid-Open Publication No. 2011-171544.

First Modification

Figure 4:
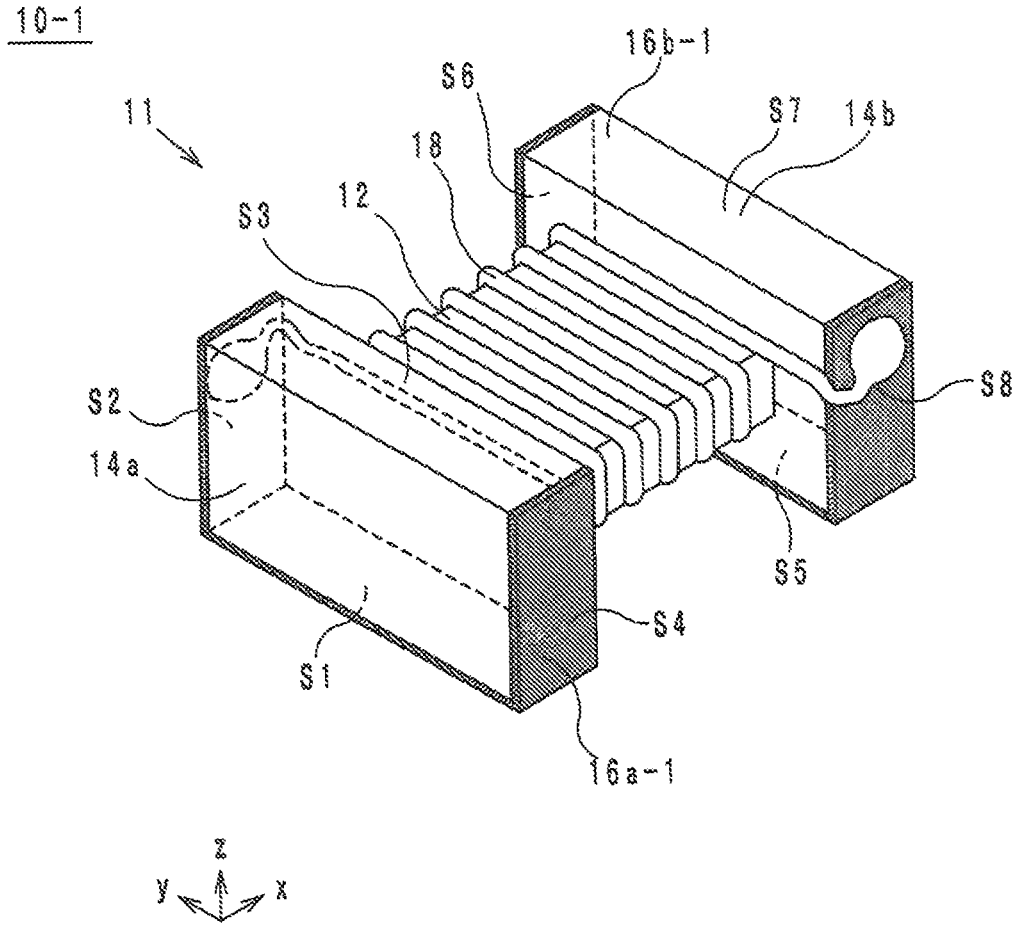
FIG. 4 is a perspective view of a first exemplary modified wire-wound electronic component.

A first exemplary modified wire-wound electronic component 10-1 is described below with reference to the drawings. FIG. 4 is a perspective view of the first modified wire-wound electronic component 10-1.

The wire-wound electronic component 10-1 is different from the wire-wound electronic component 10 in the shapes of the external electrodes 16*a* and 16*a* and in the contact points between the wire 18 and the external electrode 16*a* and between the wire 18 and the external electrode 16*a*. There are no other differences between the wire-wound electronic component 10-1 and the wire-wound electronic component 10, and only the differences are described below. The wire-wound electronic component 10-1 has external electrodes 16*a*-1 and 16*a*-1. In FIG. 4, the parts and the members of the wire-wound electronic component 10-1 that are identical to those of the wire-wound electronic component 10 are provided with the same reference marks as provided for those of the wire-wound electronic component 10.

As shown in FIG. 4, the external electrode 16*a*-1 is formed to cover the entire side surfaces S1, S2 and S4 of the flange 14*a*. The end of the wire 18 in the negative side in the x-axis direction contacts with the part of the external electrode 16*a*-1 located on the side surface S2, in the positive side in the z-direction. The external electrode 16*a*-1 is formed to cover the entire side surfaces S5, S6 and S8 of the flange 14*b*. The end of the wire 18 in the positive side in the x-axis direction contacts with the part of the external electrode 16*a*-1 located on the side surface S8, in the positive side in the z-direction.

The wire-wound electronic component 10-1 of the structure above does not need to have any external electrodes on the side surfaces S3 and S7. Therefore, the process of forming a base electrode and the process of plating on the base electrode can be simplified, and the process of cutting off the metal films can be eliminated.

Second Modification

Figure 5:
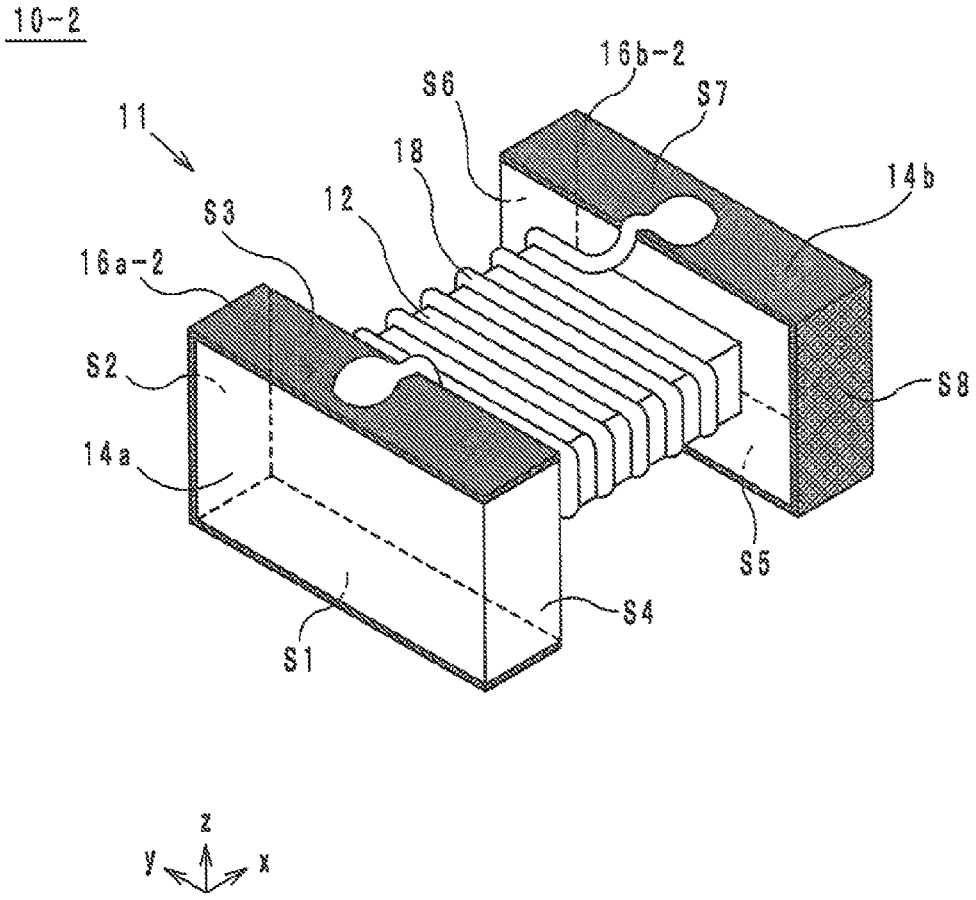
FIG. 5 is a perspective view of a second exemplary modified wire-wound electronic component.

Next, a second exemplary modified wire-wound electronic component 10-2 is described with reference to the drawings. FIG. 5 is a perspective view of the second modified wire-wound electronic component 10-2.

The wire-wound electronic component 10-2 is different from the wire-wound electronic component 10 in the shapes of the external electrodes 16*a* and 16*a* and in the contact points between the wire 18 and the external electrode 16*a* and between the wire 18 and the external electrode 16*a*. There are no other differences between the wire-wound electronic component 10-2 and the wire-wound electronic component 10, and only the differences are described below. The wire-wound electronic component 10-2 has external electrodes 16*a*-2 and 16*a*-2. In FIG. 5, the parts and the members of the wire-wound electronic component 10-2 that are identical to those of the wire-wound electronic component 10 are provided with the same reference marks as provided for those of the wire-wound electronic component 10.

As shown in FIG. 5, the external electrode 16*a*-2 is formed to entirely cover the side surfaces S1 to S3 of the flange 14*a*. The end of the wire 18 in the negative side in the x-axis direction contacts with the part of the external electrode 16*a*-2 located on the side surface S3, substantially in the center in the y-axis direction. The external electrode 16*a*-2 is formed to entirely cover the side surfaces S5, S7 and S8 of the flange 14*b*. The end of the wire 18 in the positive side in the x-axis direction contacts with the part of the external electrode 16*a*-2 located on the side surface S7, substantially in the center in the y-axis direction.

In the wire-wound electronic component 10-2 of the structure above, the length of the part of the external electrode 16*a*-2 from the end of the wire 18 to the side surface S1 (first mounting surface) is longer than the length of the part of the external electrode 16*a* from the end of the wire 18 to the side surface S1 (first mounting surface) in the wire-wound electronic component 10 shown in FIG. 1. In the wire-wound electronic component 10-2 of the structure above, also, the length of the part of the external electrode 16*a*-2 from the end of the wire 18 to the side surface S5 (second mounting surface) is longer than the length of the part of the external electrode 16*a* from the end of the wire 18 to the side surface S5 (second mounting surface) in the wire-wound electronic component 10. Consequently, the number of turns of the winding wire in the wire-wound electronic component 10-2 is greater than the number of turns of the winding wire in the wire-wound electronic component 10. Therefore, the wire-wound electronic component 10-2 can achieve a still higher inductance value without causing an increase in size.

Third Modification

Figure 6:
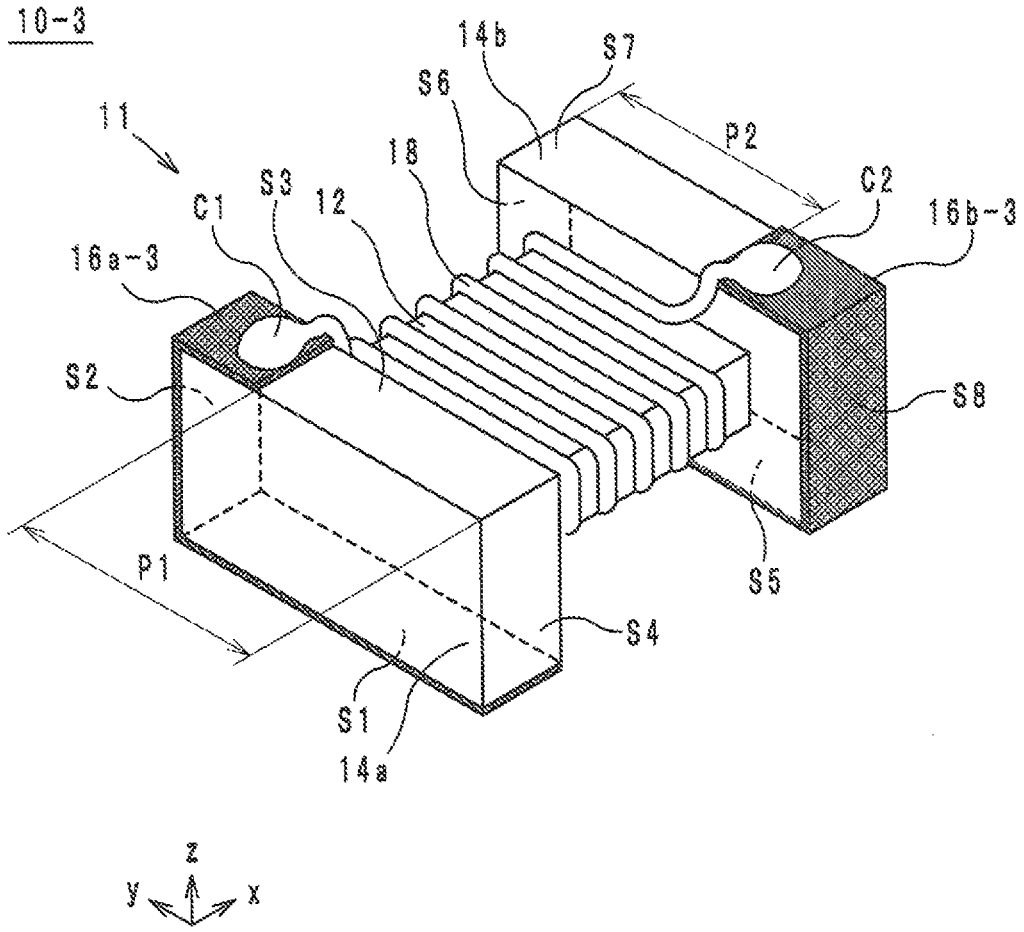
FIG. 6 is a perspective view of a third exemplary modified wire-wound electronic component.
Figure 7:
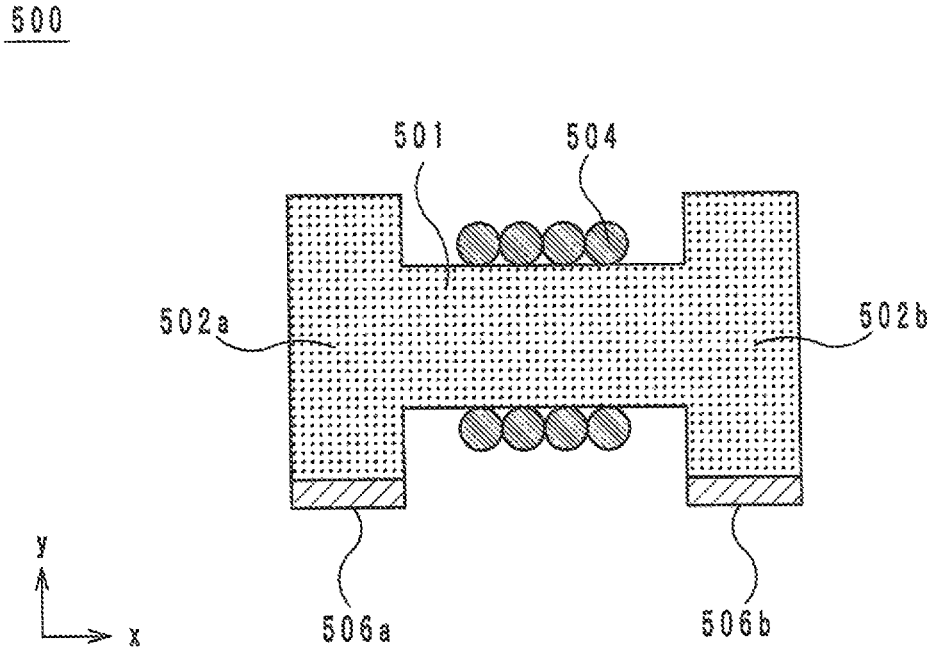
FIG. 7 PRIOR ART
FIG. 7 is a sectional view of a wire-wound coil component disclosed by Japanese Patent Laid-Open Publication No. 2011-171544.

Next, a third exemplary modified wire-wound electronic component 10-3 is described with reference to the drawings. FIG. 6 is a perspective view of the third modified wire-wound electronic component 10-3.

The wire-wound electronic component 10-3 is different from the wire-wound electronic component 10 in the shapes of the external electrodes 16*a* and 16*a* and in the contact points between the wire 18 and the external electrode 16*a* and between the wire 18 and the external electrode 16*a*. There are no other differences between the wire-wound electronic component 10-3 and the wire-wound electronic component 10, and only the differences are described below. The wire-wound electronic component 10-3 has external electrodes 16*a*-3 and 16*a*-3. In FIG. 6, the parts and the members of the wire-wound electronic component 10-3 that are identical to those of the wire-wound electronic component 10 are provided with the same reference marks as provided for those of the wire-wound electronic component 10.

As shown in FIG. 6, the external electrode 16*a*-3 is formed on the flange 14*a*, essentially only in a region from a contact point C1 on the side surface S3 at which an end of the wire 18 contacts with the external electrode 16*a*-3 to and including the side surface S1 (first mounting surface) across the side surface S2. The external electrode 16*a*-3 is formed on the flange 14*b*, essentially only in a region from a contact point C2 on the side surface S7 at which the other end of the wire 18 contacts with the external electrode 16*a*-3 to and including the side surface S5 (second mounting surface) across the side surface S8.

In the wire-wound electronic component 10-3 of the structure above, the external electrode 16*a*-3 does not spread in a part (non-electrode portion) P1 of the side surface S3, at least to any significant extent, that is, in the farther negative side than the contact point C1 in the y-axis direction, and does not spread on the side surface S4. The external electrode 16*a*-3 does not spread in a part (non-electrode portion) P2 of the side surface S7, at least to any significant extent, that is, in the farther positive side than the contact point C2 in the y-axis direction, and does not spread on the side surface S6. Accordingly, in the wire-wound electronic component 10-3, no eddy currents occur in the non-electrode portions P1 and P2 and on the side surfaces S4 and S6. The wire-wound electronic component 10-3 can achieve a still higher inductance value and a still higher Q-value.

Other Embodiments

The structures of the wire-wound electronic components 10, 10-1, 10-2 and 10-3 may be combined with one another.

Although the present disclosure has been described in connection with the preferred embodiments above, it is to be noted that various changes and modifications may be apparent to a person skilled in the art. Such changes and modifications are to be understood as being within the scope of the disclosure.

What is claimed is:

1. A wire-wound electronic component comprising:

a core having a winding base extending in an axial direction, and a first flange provided at a first end of the winding base in the axial direction;

a wire wound around the winding base; and a first external electrode that is provided only on a plurality of first side surfaces of the first flange and that is connected to a first end of the wire, the first side surfaces being peripheral surfaces of the first flange in directions orthogonal to the axial direction;

wherein a first connecting surface on which the first end of the wire contacts with the first external electrode is one of the first side surfaces that is different from one of the first side surfaces that functions as a first mounting surface;

wherein the first external electrode extends from the first mounting surface to the first end of the wire in such a manner to turn in a direction the same as a first winding direction in which the wire winds from the first end to a second end;

wherein the core further has a second flange provided at a second end of the winding base in the axial direction;

wherein the wire-wound electronic component further comprises a second external electrode that is provided only on a plurality of second side surfaces of the second flange and that is connected to a second end of the wire, the second side surfaces being peripheral surfaces of the second flange in directions orthogonal to the axial direction;

wherein a second connecting surface on which the second end of the wire contacts with the second external electrode is one of the second side surfaces that is different from one of the second side surfaces that functions as a second mounting surface; and wherein the second external electrode extends from the second mounting surface to the second end of the wire in such a manner to turn in a direction the same as a second winding direction in which the wire winds from the second end to the first end.

2. The wire-wound electronic component according to claim 1, wherein the first external electrode is provided only in a region of the first side surfaces from a first contact point at which the first end of the wire contacts with the first external electrode to and including the first mounting surface.

3. The wire-wound electronic component according to claim 1, wherein the first connecting surface and the second connecting surface are in sides that face in a same direction, when viewed from the axial direction, with respect to a central axis of the winding base.

4. The wire-wound electronic component according to claim 3, wherein the second external electrode is provided only in a region from a second contact point at which the end of the wire contacts with the second external electrode to the second mounting surface.

5. The wire-wound electronic component according to claim 1, wherein a cross-section area of the first external electrode is greater than a cross-section area of the wire.

6. The wire-wound electronic component according to claim 1, wherein the first external electrode is not provided on a surface of the first flange facing the axial direction.

7. The wire-wound electronic component according to claim 1, wherein the first external electrode is not provided on a portion of at least one of the first sides.

* * * * *